US006125892A

United States Patent [19]

Fritzson

[11] Patent Number: 6,125,892

[45] Date of Patent: Oct. 3, 2000

[54] YARN FEEDING APPARATUS AND BRAKING DEVICE INCLUDING AN ELASTIC ANNULAR MEMBRANE

[75] Inventor: Joachim Fritzson, Ulricehamn, Sweden

[73] Assignee: IRO AB, Ulriceham, Sweden

[21] Appl. No.: 09/254,194

[22] PCT Filed: Aug. 28, 1997

[86] PCT No.: PCT/EP97/04698

§ 371 Date: Jun. 15, 1999

§ 102(e) Date: Jun. 15, 1999

[87] PCT Pub. No.: WO98/08767

PCT Pub. Date: Mar. 5, 1998

[30] Foreign Application Priority Data

Aug. 29, 1996 [DE] Germany ..... 196 34 972

[51] Int. Cl.[7] ..... B65H 51/22; D03D 47/36

[52] U.S. Cl. ..... 139/452; 242/365.4

[58] Field of Search ..... 139/452; 242/365.4

[56] References Cited

U.S. PATENT DOCUMENTS 5,409,043 4/1995 Zenoni et al. .

5,738,291 4/1998 Tholander ..... 139/452

5,947,403 9/1999 Johansson et al. ..... 139/452

FOREIGN PATENT DOCUMENTS

9406102U1 9/1995 Germany .

WO 94/12420 6/1994 WIPO .

WO94/20402 9/1994 WIPO .

WO 95/24355 9/1995 WIPO .

*Primary Examiner*—Andy Falik

*Attorney, Agent, or Firm*—Flynn, Thiel, Boutell & Tanis, P.C.

[57] ABSTRACT

A device for braking a yarn and a yarn feeding apparatus having a stationary storage body for a yarn store with an annular withdrawal surface. The braking device includes a frustoconical flexible braking band which is arranged approximately coaxially relative to the withdrawal surface and to which pressure is applied in the axial direction to press the braking band against the withdrawal surface. A ring-shaped membrane made of an elastomeric or rubber material is joined in a force transmitting manner to the braking band and is supported in an outer ring holder. An end region of the annular membrane is bent back inwardly in a direction towards the withdrawal surface and is joined to the braking band thereat.

20 Claims, 1 Drawing Sheet

YARN FEEDING APPARATUS AND BRAKING DEVICE INCLUDING AN ELASTIC ANNULAR MEMBRANE

FIELD OF THE INVENTION

The present invention relates to a device according to the preamble part of claim 1 and to a yarn feeding apparatus according to claim 16.

BACKGROUND OF THE INVENTION

In a device as known from PCT/EP94/00476 (WO 94/20402) the small diameter end region of the membrane is connected to the braking band such that the annular membrane extends outwardly from the large diameter edge of the braking band. When the annular membrane is displaced with its ring holder counter to the withdrawal direction of the yarn it undergoes a bending and pulling load from which the axial force load for the braking band results by which the braking band is pressed against the withdrawal surface. The annular membrane unifies in it the spring function for holding the braking band against the withdrawal surface and the function of a transmission body transmitting said axial force load from the ring holder to the braking band. In said arrangement, in practice, an irregular braking effect may occur for the yarn due to a misalignment between the braking band and the withdrawal surface along the essentially line-shaped contact zone between the braking band and the withdrawal surface. Moreover, the braking band is locally distorted counter to the withdrawal direction of the yarn in a yarn passage region when responding to the friction force and the repelling force of the yarn, said distortion hindering the achievement of a uniform tension level in the withdrawn yarn.

In other yarn feeding apparatuses (U.S. Pat. No. 5,409,043, U.S. Pat. No. 5,316,051), the axial force load is transmitted to the braking band by means of a hollow body having the shape of a frustocone into which the braking band is glued to the inner side of the hollow body. Said hollow body is supported at its outer side by means of a spring arrangement or an annular membrane which is elastic in the axial direction of the storage body, however, in the radial direction is relatively rigid. At the other side the hollow body is stiff in axial direction and elastic in the radial direction such that the flexible braking band is apt to deform locally in the yarn passage region and despite the axial force load. Said design requires multiple parts. The hollow body is highly loaded and tends to fatigue. The yarn feeding apparatus also consumes a large amount of space.

In another device known from DE-U-94 06 102, a plastic foam ring is glued to the outer side of the braking band which is held in the large diameter end of a rigid, frusto-conical hollow body. A spring assembly engages at said hollow body which generates the axial force load for the braking band. Due to the relatively forceful spring assembly, the soft plastic foam ring is strongly deformed so that the inherent movability of the flexible braking band is restricted. The braking band bears onto a conical withdrawal surface of the storage body.

It is an object of the invention to create a device of the type disclosed above, as well as a yarn feeding apparatus in which along the contact zone between the braking band and the withdrawal surface, a uniform braking effect can be generated, and in which a substantially constant tension level can be maintained in the yarn being withdrawn.

This object can be achieved by providing a frusto-conical braking band oriented generally coaxially with the withdrawal surface defined on the storage body of a yarn feeding apparatus. An elastic annular membrane is connected at an outer end region thereof having the large diameter to a holding member, and an inner end region of the membrane having the small diameter is bent inwardly in a direction toward the withdrawal surface and is connected to the braking band.

The device saves space and consists of only two parts. Due to the bend of the small diameter end region of the annular membrane the braking band is no longer pulled against the withdrawal surface but is pushed against it. The braking band properly centers itself in operation thanks to the bend so that the braking effect along the contact zone remains uniform. It is imaginable that the braking band under the friction force and the repelling force of the yarn tends to locally enlarge the cone apex angle in the yarn passage region, i.e. to distort in withdrawal direction. A strong load exerted from the yarn onto the braking band, e.g. as occurs with a strong acceleration of the yarn or in case of high withdrawal speed, can result in a sickle-shaped gap between the withdrawal surface and the braking band in which gap the withdrawal resistance for the yarn may decrease. In such operational phases wherein the tension in the yarn being withdrawn is already increased, due to acceleration or high withdrawal speed, only a negligible contribution to the tension increase will be added by the braking device. To the contrary, in case of a low load exerted by the yarn on the braking band, the cone apex angle of the braking band in the yarn passage region will be reduced locally and thence the braking effect increases in order to raise the then already low yarn tension. This may help to maintain constant the yarn tension in the yarn being withdrawn. Due to this the device then operates with a self-compensation effect, i.e. the braking effect automatically is decreased when the yarn tension rises and automatically is increased when the yarn tension drops. With given outer dimensions of the ring holder mainly by the cross-sectional configuration of the annular membrane, an optimal large radial extension of the annular membrane can be used for its deformation. Since the connecting region is situated at an optimal small diameter the inherent movability or flexibility of the braking band is disturbed as little as possible, while the bend backwards and inwards (a bend like a U-turn) improves the self-centering capability of the braking band on the withdrawal surface.

The proper centering of the braking band and the constant tension level can be achieved by providing the membrane with a cross-section which, starting from the outer end region thereof, extends generally toward the braking band, and then extends to a position generally beyond same, and then extends inwardly toward the radial position of a small diameter edge of the braking band and finally extends, with its bend, to the braking band.

The major force load-transmission from the annular membrane to the braking band takes place within the diameter of the contact zone between the braking band and the withdrawal surface. Due to this, the braking band, preferably being a very thin flexible metal body, distorts itself in the yarn passage region in case of stronger yarn load by locally enlarging the cone apex angle in withdrawal direction. This helps maintain a constant yarn tension.

The transmission of the force load onto the braking band via the membrane is carried out very uniformly. The annular membrane is very flexible at the bent region thereof such that the inherent movability of the braking band due to the load from the yarn is hindered as little as possible. The arcuate bend also aids in the self-centering of the braking band on the withdrawal surface.

With regard to manufacturing, it is advantageous to leave both edges of the braking band free.

The self-centering effect of the braking band is enhanced by providing the membrane with an essentially S-shaped cross-section.

The wall thickness of the membrane, at least in the area of the small diameter end region thereof, decreases gradually so that the inherent movability or flexibility of the braking band is hindered only minimally.

The membrane, at the outer end region thereof, is bent in a direction opposite the bend of the inner end region. This outer bend is significantly deformed when transmitting the force load onto the braking band. The deformation motions and forces occurring in this region, however, are remote from the braking band so that they do not interfere with the proper operation of the braking band in its braking function.

The membrane, between the inner and outer bent portions has an arc-shaped interconnecting portion which separates or decouples the bent portions from one another.

In accordance with one embodiment, the decoupling of the inner and outer bent portions is enhanced by at least one further concentric undulation.

The bend of the annular membrane at the inner end region thereof having the small diameter may be fixed at the outer side and/or at the inner side of the braking band. Gluing or vulcanising lead to very homogenous and durable connection regions. In case that the bend is secured to the inner side of the braking band then the bend grips or folds around the small diameter edge of the braking band. Optionally, the connection is made directly at the small diameter edge of the braking band.

A cone apex angle of the braking band within a range of about 120°, e.g. between 90° and 140°, allows the device to sensitively respond to accelerations or decelerations of the yarn. In connection with precise self-centering effect of the braking band at the withdrawal surface, a substantially constant tension level in the yarn being withdrawn can be achieved.

The withdrawal surface of the storage body is curved convexly, and an essentially line-shaped contact zone exists between the braking band and the withdrawal surface, in which contact zone the yarn is braked. A gradually tapering inlet leads to the braking nip which is advantageous for the yarn which during its withdrawal motion (balloon formation) also moves crosswise to its running direction. Moreover downstream of the braking nip, a gradually diverging outlet region is formed in which the outgoing yarn is able to move freely.

The interconnecting portion between the bent portions has a configuration which conforms to the withdrawal surface of the storage drum, which results in favorable kinematic relations. The interconnecting portion and the outwardly situated bend may fulfill an additional and desirable function, namely the function of a balloon limiter by which the yarn running with high withdrawal speed can be hindered from leaving the surface of the storage drum by too great a distance.

In a yarn feeding device equipped with the braking device according to the invention, a substantially constant tension level can be achieved in the yarn being withdrawn due to a proper self-centering of the braking band. The braking device consumes only mounting space inside the yarn feeding apparatus.

BRIEF DESCRIPTION OF THE DRAWINGS

Embodiments of the subject of the invention will be described with the help of the drawings, in which.

DETAILED DESCRIPTION

Figure 1:
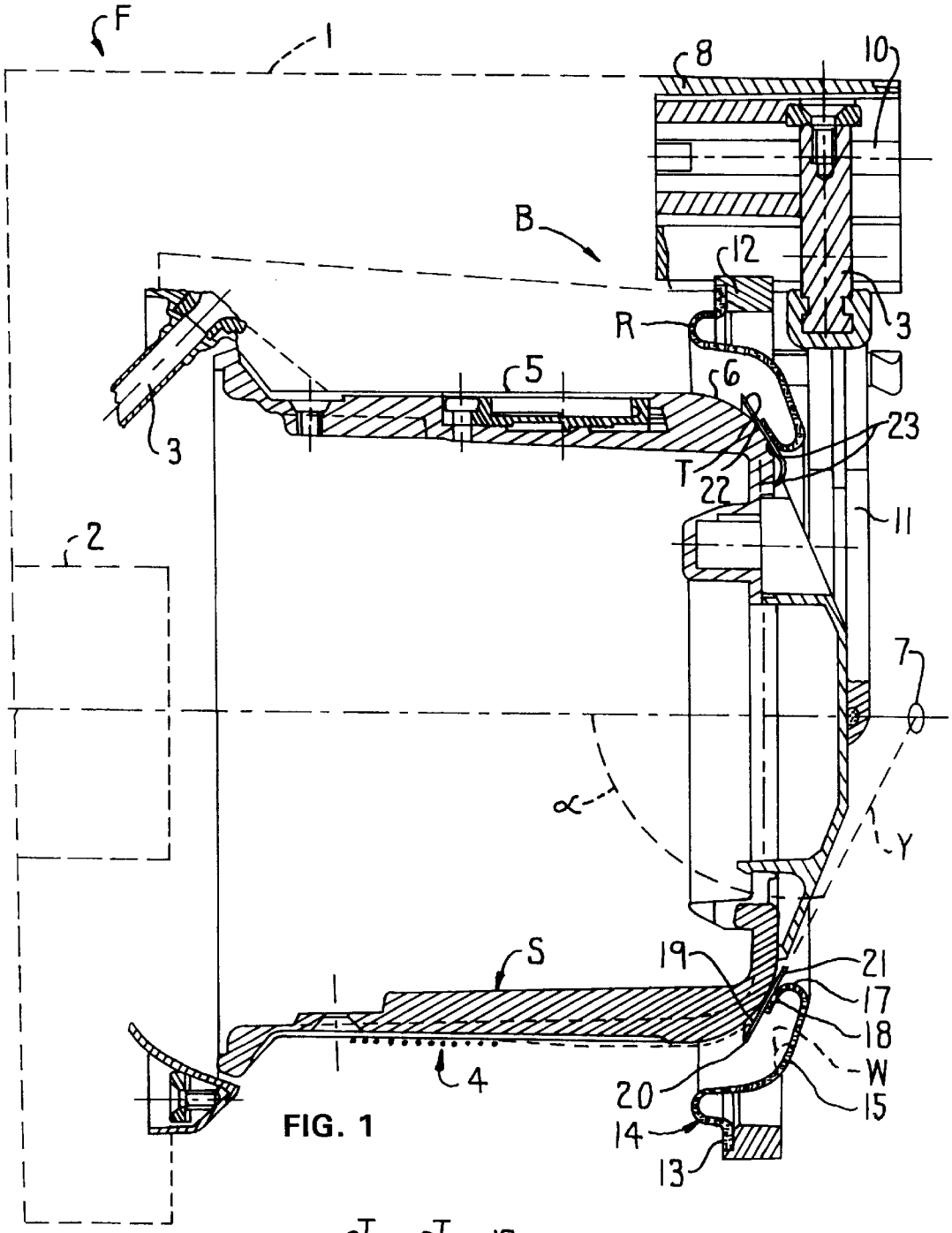
FIG. 1 is a fragmentary longitudinal cross-sectional view of a yarn feeding apparatus including a device for braking a yarn.

A yarn feeding apparatus F, equipped with a device B for braking a yarn Y, particularly a yarn feeding apparatus for projectile or gripper weaving machines, includes a schematically indicated housing 1 receiving a drive motor 2 for a winding element 3 as well as a stationary storage body S. A housing bracket 8 is provided on housing 1. The yarn Y is withdrawn from a storage bobbin (not shown), is inserted into the housing 1 from the left side in FIG. 1 and is passed through the winding element 3 which due to the rotational motion of the drive motor 2 winds the yarn Y in windings tangentially onto the surface 5 of the storage body S (yarn store 4). Not shown means impart an advance motion to the yarn windings in FIG. 1 to the right side. At the free front end of storage body S a convexly curved withdrawal surface 6 is situated which is concentric to the axis of storage body S. Coaxial to storage body S a yarn guiding element 7 is provided through which the yarn is withdrawn axially, such that the yarn Y first is deflected around the withdrawal surface 6, is pulled through device B simultaneously and is orbiting like one hand of a clock around said withdrawal surface 6.

A ring holder 11 is secured to a swivel pivot 9 which can be adjusted or displaced within housing bracket 8 essentially parallel to the axis of storage body S by means of an adjustment device 10. Ring holder 11 supports a carrier ring 12. Carrier ring 12 in turn supports an annular membrane or ring membrane R, e.g. of elastomeric or rubber-like material, which membrane is formed essentially S-like in its cross-section. The small diameter inner region of annular membrane R is connected to a frustoconical braking band T which preferably consists of thin sheet metal 19 and which is very flexible but stretch-proof.

The annular membrane R includes an outer holding ring flange 13 which is connected with carrier ring 12. A bend 14 situated radially outwardly of withdrawal surface 6, is connected to said outer holding ring flange 13. The bend 14 is connected to a further bend 17 by means of a connecting section 15 which is—in cross-section—curved arcuately to the outer side. The connecting section 15 is designed like a 180°-arc and has an end part 18 which is secured to the braking band T by gluing or vulcanisation. In the shown embodiment, the inner and outer edges 20, 21 of braking band T are free. Within connecting section 15 at least a further undulation W could be formed. The braking band T defines a braking surface 22 which is continuous in the circumferential direction and wear and heat-proof. Said braking surface 22 bears on withdrawal surface 6 along a circular contact zone 23. The edges 20 and 21 of the braking band T, being straight in its cross-section, are spaced from withdrawal surface 6. The major part of the connecting section or area where the end part 18 adjacent bend 17 attaches to the braking band T is situated inside or radially inwardly of the diameter of contact zone 23.

Depending on the yarn quality processed by the yarn feeding apparatus F, the axial position of the ring holder 11 is adjusted such that a predetermined axial contact pressure is achieved for the braking band T. As soon as the yarn Y is withdrawn, it passes between the braking band T and the withdrawal surface 6, and additionally is orbiting between the braking band T and the withdrawal surface 6 like one hand of a clock. The braking band T in the yarn passage region is locally deformed. In the vicinity of the yarn a sickle-shaped opening may be generated. The end part 18 and the bend 17 do not interfere with the inherent movability of the braking band T. In case that the yarn is strongly accelerated or is withdrawn at a high speed, the friction force and the repelling force imparted by the yarn onto the brake band T are relatively high. The braking band T thus is tilting in the passage region of the yarn slightly, e.g. in the withdrawal direction (increase of the cone apex angle $\alpha$), such that the braking effect is decreasing. In case of low yarn speed or in case of decreasing yarn speed the forces from the yarn on the braking band are also decreasing. The brake band can distort opposite to the withdrawal direction and in the yarn passage region such that the cone apex angle $\alpha$ becomes smaller. According to this the braking effect automatically is increasing. The braking device automatically is adapting in this manner to the respective requirements in order to maintain a substantially constant tension level in the yarn being withdrawn.

Figure 2A:
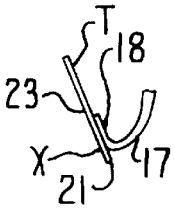
FIGS. 2A–2D are fragmentary, cross-sectional views of variations of the annular membrane.
Figure 2B:
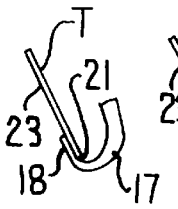
Figure 2C:
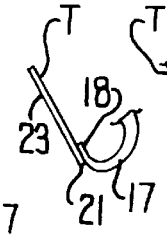
Figure 2D:
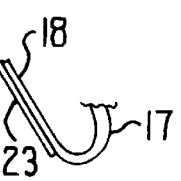

According to FIG. 2*a,* with edge 21 of braking band T left free, the connecting region between end part 18 of bend 17 and the braking band T is situated within or radially inwardly of the diameter of the contact zone 23. According to FIG. 2*b,* the bend 17 with its end part 18 grips around edge 21 of braking band T. According to FIG. 2*c,* the transition from end part 18 into bend 17 is situated at edge 21 of braking band T. According to FIG. 2*d,* end part 18 of bend 17 covers almost the entire outer surface of braking band T.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A device for braking a yarn during withdrawal thereof from a yarn supply stored on a storage body, the storage body defining an axis and an annular withdrawal surface from which the yarn is withdrawn in an orbiting motion therearound and guided through a guide element oriented generally coaxially relative to the withdrawal surface, said device comprising:

a frusto-conical and flexible annular braking band oriented generally coaxially relative to the withdrawal surface and axially biased thereagainst; and an elastic annular membrane having an outer region supported by a ring-shaped holder, an inner peripheral region having a diameter less than a diameter of said outer peripheral region and defining a bent portion which bends inwardly toward the withdrawal surface, said bent portion being connected to said braking band such that said membrane transmits axial force to said braking band.

2. The device of claim 1 wherein said membrane, when viewed in cross-section taken radially therethrough and starting at said outer peripheral region, extends generally radially inwardly toward said braking band and then to a location generally axially beyond said braking band, and from said location said bent portion extends generally axially toward an inner peripheral edge of said braking band and is connected thereat.

3. The device of claim 1 wherein said braking band is biased against the withdrawal surface such that an annular contact zone is defined therebetween, and a connection area is defined at the junction of said bent portion and said braking band, a substantial portion of said connection area being disposed radially inwardly of said contact zone.

4. The device of claim 1 wherein a connection area is defined at the junction of said bent portion and said braking band and a transitional area of said membrane defined between said bent portion and said connection area is disposed closely adjacent an inner peripheral edge of said braking band.

5. The device of claim 1 wherein said bent portion is arc-shaped and defines an arc length of about 180 degrees.

6. The device of claim 1 wherein a connection area is defined at the junction of said bent portion and said braking band, said braking band defines an inner peripheral edge and an outer peripheral edge having a diameter greater than said inner peripheral edge, said connection area being disposed between said inner and outer peripheral edges such that said peripheral edges of said braking band are free of connection to said membrane.

7. The device of claim 1 wherein said membrane has a generally S-shaped cross-sectional configuration taken radially through said membrane.

8. The device of claim 1 wherein a wall thickness of said membrane at least adjacent said inner peripheral region decreases gradually in a direction toward said braking band.

9. The device of claim 1 wherein said bent portion is a first bent portion, and said outer peripheral region of said membrane is defined by a second bent portion and a flange, said flange being connected to said ring-shaped holder, and said second bent portion has a curvature which is reversed from a curvature of said first bent portion.

10. The device of claim 1 wherein an undulation is disposed between said inner and outer peripheral regions and extends circumferentially about said membrane.

11. The device of claim 1 wherein said braking band defines a first surface which faces the withdrawal surface and a second surface which faces away therefrom, said bent portion being connected to one of said first and second sides of said braking band via adhesive or vulcanization.

12. The device of claim 1 wherein said braking band is oriented in a plane which defines an angle of about 120 degrees with the axis defined by the storage body, said angle comprising a cone apex angle.

13. The device of claim 1 wherein said membrane includes an intermediate region disposed between said inner and outer peripheral regions, said intermediate region having a shape which generally conforms to the shape of the withdrawal surface of the storage body.

14. The device of claim 1 wherein said bent portion is a first bent portion and said membrane includes an intermediate region disposed between said inner and outer peripheral regions, said membrane, when viewed in radial cross-section and starting at said outer peripheral region thereof, includes a second bent portion which forms at least part of said outer peripheral region and which has a reverse curvature than that of said first bent portion, said second bent portion smoothly adjoining said intermediate region which is spaced from and has a shape which generally conforms to a shape of the withdrawal surface, said intermediate region smoothly adjoining said first bent portion, and said first bent portion curving towards said braking band and having a terminal end portion connected thereto.

15. The device of claim 14 wherein said outer peripheral region includes a flange which is disposed radially outwardly of said second bent portion and which is connected to said holder, said braking band is biased against the withdrawal surface such that an annular contact zone is defined therebetween, and a connection area is defined at the junction of said first bent portion and said braking band, a substantial portion of said connection area being disposed radially inwardly of said contact zone.

16. A yarn feeding apparatus comprising:

a storage body for storing a yarn supply in windings thereon, said storage body defining an axis and an annular withdrawal surface;

a guide element through which yarn is guided during withdrawal thereof from said withdrawal surface, said guide element being disposed adjacent said withdrawal surface and oriented generally coaxially relative thereto;

a braking device positioned adjacent said storage body, said braking device including:

a frusto-conical and flexible annular braking band oriented generally coaxially relative to said withdrawal surface and axially biased thereagainst such that as yarn is withdrawn axially from said withdrawal surface the yarn orbits between said braking band and said withdrawal surface; and an elastic annular membrane having an outer peripheral region supported by a ring-shaped holder, an inner peripheral region having a diameter less than a diameter of said outer peripheral region and defining a bent portion which bends inwardly toward said withdrawal surface, said bent portion being connected to said braking band such that said membrane transmits axial force to said braking band.

17. The yarn feeding apparatus of claim 16 wherein said withdrawal surface has a convex curvature.

18. The yarn feeding apparatus of claim 17 wherein said membrane includes an intermediate region disposed between said inner and outer peripheral regions, said intermediate region having a shape which generally conforms to said convex curvature of said withdrawal surface.

19. The yarn feeding apparatus of claim 16 wherein said withdrawal surface is generally convex in shape and said membrane positions said braking band tangentially relative to said withdrawal surface.

20. The yarn feeding apparatus of claim 19 wherein said bent portion is a first bent portion and said membrane includes an intermediate region disposed between said inner and outer peripheral regions, said membrane, when viewed in radial cross-section and starting at said outer peripheral region thereof, includes a second bent portion which forms at least part of said outer peripheral region and which has a reverse curvature than that of said first bent portion, said second bent portion smoothly adjoining said intermediate region which is spaced from and has a shape which generally conforms to said convex shape of said withdrawal surface, said intermediate region smoothly adjoining said first bent portion, and said first bent portion curving toward said braking band and having a terminal end portion connected thereto.

* * * * *

UNITED STATES PATENT AND TRADEMARK OFFICE

CERTIFICATE OF CORRECTION

PATENT NO. : 6,125,892
DATED : October 3, 2000
INVENTOR(S) : Fritzson, Joachim

It is certified that error appears in the above-identified patent and that said Letters Patent is hereby corrected as shown below:

Column 6, line 35; change "surface" (first occurrence) to ---side---.

Column 6, line 36; change "surface" to ---side---.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*